US007957963B2

(12) United States Patent
Hardwick

(10) Patent No.: US 7,957,963 B2
(45) Date of Patent: Jun. 7, 2011

(54) VOICE TRANSCODER

(75) Inventor: John C. Hardwick, Sudbury, MA (US)

(73) Assignee: Digital Voice Systems, Inc., Westford, MA (US)

( * ) Notice: Subject to any disclaimer, the term of this patent is extended or adjusted under 35 U.S.C. 154(b) by 0 days.

(21) Appl. No.: 12/637,383

(22) Filed: Dec. 14, 2009

(65) Prior Publication Data

US 2010/0094620 A1 Apr. 15, 2010

Related U.S. Application Data

(62) Division of application No. 10/353,974, filed on Jan. 30, 2003, now Pat. No. 7,634,399.

(51) Int. Cl.
*G10L 19/00* (2006.01)

(52) U.S. Cl. ..... 704/223; 704/219; 704/201; 704/500

(58) Field of Classification Search ..... 704/201, 704/219, 223, 500

See application file for complete search history.

(56) References Cited

U.S. PATENT DOCUMENTS

| | | | |
|---|---|---|---|
| 3,622,704 | A | 11/1971 | Ferrieu et al. |
| 3,903,366 | A | 9/1975 | Coulter |
| 5,081,681 | A | 1/1992 | Hardwick et al. |
| 5,086,475 | A | 2/1992 | Kutaragi et al. |
| 5,195,166 | A | 3/1993 | Hardwick et al. |
| 5,216,747 | A | 6/1993 | Hardwick et al. |
| 5,226,084 | A | 7/1993 | Hardwick et al. |
| 5,226,108 | A | 7/1993 | Hardwick et al. |
| 5,247,579 | A | 9/1993 | Hardwick et al. |
| 5,491,772 | A | 2/1996 | Hardwick et al. |
| 5,517,511 | A | 5/1996 | Hardwick et al. |
| 5,581,656 | A | 12/1996 | Hardwick et al. |
| 5,630,011 | A | 5/1997 | Lim et al. |
| 5,649,050 | A | 7/1997 | Hardwick et al. |
| 5,664,051 | A | 9/1997 | Hardwick et al. |
| 5,664,052 | A | 9/1997 | Nishiguchi et al. |
| 5,701,390 | A | 12/1997 | Griffin et al. |
| 5,715,365 | A | 2/1998 | Griffin et al. |
| 5,742,930 | A | 4/1998 | Howitt |

(Continued)

FOREIGN PATENT DOCUMENTS

| | | | |
|---|---|---|---|
| EP | 1020848 | A2 | 7/2000 |

(Continued)

OTHER PUBLICATIONS

European Search Report; Application No. EP 03 25 7038; Feb. 10, 2004; 3 pages.

(Continued)

*Primary Examiner* — Daniel D Abebe
(74) *Attorney, Agent, or Firm* — Fish & Richardson P.C.

(57) ABSTRACT

First encoded voice bits are transcoded into second encoded voice bits by dividing the first encoded voice bits into one or more received frames, with each received frame containing multiple ones of the first encoded voice bits. First parameter bits for at least one of the received frames are generated by applying error control decoding to one or more of the encoded voice bits contained in the received frame, speech parameters are computed from the first parameter bits, and the speech parameters are quantized to produce second parameter bits. Finally, a transmission frame is formed by applying error control encoding to one or more of the second parameter bits, and the transmission frame is included in the second encoded voice bits.

22 Claims, 7 Drawing Sheets

U.S. PATENT DOCUMENTS

| | | | | |
|---|---|---|---|---|
| 5,754,974 | A | 5/1998 | Griffin et al. | |
| 5,826,222 | A | 10/1998 | Griffin | |
| 5,870,405 | A | 2/1999 | Hardwick et al. | |
| 6,018,706 | A | 1/2000 | Huang et al. | |
| 6,064,955 | A | 5/2000 | Huang et al. | |
| 6,131,084 | A | 10/2000 | Hardwick | |
| 6,161,089 | A | 12/2000 | Hardwick | |
| 6,199,037 | B1 | 3/2001 | Hardwick | |
| 6,377,916 | B1 | 4/2002 | Hardwick | |
| 6,484,139 | B2 | 11/2002 | Yajima | |
| 6,502,069 | B1 | 12/2002 | Grill et al. | |
| 6,504,838 | B1 * | 1/2003 | Kwan | 370/352 |
| 6,675,148 | B2 | 1/2004 | Hardwick | |
| 6,912,495 | B2 | 6/2005 | Griffin et al. | |
| 6,963,833 | B1 | 11/2005 | Singhal | |
| 6,968,309 | B1 * | 11/2005 | Makinen et al. | 704/219 |
| 2003/0050775 | A1 | 3/2003 | Zinser et al. | |
| 2003/0135374 | A1 | 7/2003 | Hardwick | |
| 2004/0093206 | A1 | 5/2004 | Hardwick | |
| 2005/0267743 | A1 * | 12/2005 | Gerlach | 704/221 |
| 2005/0278169 | A1 | 12/2005 | Hardwick | |

FOREIGN PATENT DOCUMENTS

| | | |
|---|---|---|
| JP | HEI5346797 | 12/1993 |
| JP | HEI10293600 | 11/1998 |
| WO | WO9804046 A3 | 1/1998 |

OTHER PUBLICATIONS

Non-Final Office Action, U.S. Appl. No. 10/292,460 dated Jul. 19, 2006.

* cited by examiner

VOICE TRANSCODER

CLAIM OF PRIORITY

This application is a continuation (and claims the benefit of priority under 35 U.S.C. §120) of U.S. patent application Ser. No. 10/353,974, filed Jan. 30, 2003, which is incorporated by reference.

TECHNICAL FIELD

This description relates generally to the encoding and/or decoding of speech and other audio signals and to methods for converting between different speech coding systems.

BACKGROUND

Speech encoding and decoding have a large number of applications and have been studied extensively. In general, speech coding, which is also known as speech compression, seeks to reduce the data rate needed to represent a speech signal without substantially reducing the quality or intelligibility of the speech. Speech compression techniques may be implemented by a speech coder, which also may be referred to as a voice coder or vocoder.

A speech coder is generally viewed as including an encoder and a decoder. The encoder produces a compressed stream of bits from a digital representation of speech, such as may be generated at the output of an analog-to-digital converter having as an input an analog signal produced by a microphone. The decoder converts the compressed bit stream into a digital representation of speech that is suitable for playback through a digital-to-analog converter and a speaker. In many applications, the encoder and the decoder are physically separated, and the bit stream is transmitted between them using a communication channel.

A key parameter of a speech coder is the amount of compression the coder achieves, which is measured by the bit rate of the stream of bits produced by the encoder. The bit rate of the encoder is generally a function of the desired fidelity (i.e., speech quality) and the type of speech coder employed. Different types of speech coders have been designed to operate at different bit rates. Recently, low to medium rate speech coders operating below 10 kbps have received attention with respect to a wide range of mobile communication applications (e.g., cellular telephony, satellite telephony, land mobile radio, and in-flight telephony). These applications typically require high quality speech and robustness to artifacts caused by acoustic noise and channel noise (e.g., bit errors).

Speech is generally considered to be a non-stationary signal having signal properties that change over time. This change in signal properties is generally linked to changes made in the properties of a person's vocal tract to produce different sounds. A sound is typically sustained for some short period, typically 10-100 ms, and then the vocal tract is changed again to produce the next sound. The transition between sounds may be slow and continuous or it may be rapid as in the case of a speech "onset." This change in signal properties increases the difficulty of encoding speech at lower bit rates since some sounds are inherently more difficult to encode than others and the speech coder must be able to encode all sounds with reasonable fidelity while preserving the ability to adapt to a transition in the characteristics of the speech signals. One way to improve the performance of a low to medium bit rate speech coder is to allow the bit rate to vary. In variable-bit-rate speech coders, the bit rate for each segment of speech is allowed to vary between two or more options depending on various factors, such as user input, system loading, terminal design or signal characteristics.

There have been several main approaches for coding speech at low to medium data rates. For example, an approach based around linear predictive coding (LPC) attempts to predict each new frame of speech from previous samples using short and long term predictors. The prediction error is typically quantized using one of several approaches of which CELP and/or multi-pulse are two examples. The advantage of the linear prediction method is that it has good time resolution, which is helpful for the coding of unvoiced sounds. In particular, plosives and transients benefit from this in that they are not overly smeared in time. However, linear prediction typically has difficulty for voiced sounds in that the coded speech tends to sound rough or hoarse due to insufficient periodicity in the coded signal. This problem may be more significant at lower data rates that typically require a longer frame size and for which the long-term predictor is less effective at restoring periodicity.

Another leading approach for low to medium rate speech coding is a model-based speech coder or vocoder. A vocoder models speech as the response of a system to excitation over short time intervals. Examples of vocoder systems include linear prediction vocoders such as MELP, homomorphic vocoders, channel vocoders, sinusoidal transform coders ("STC"), harmonic vocoders and multiband excitation ("MBE") vocoders. In these vocoders, speech is divided into short segments (typically 10-40 ms), with each segment being characterized by a set of model parameters. These parameters typically represent a few basic elements of each speech segment, such as the segment's pitch, voicing state, and spectral envelope. A vocoder may use one of a number of known representations for each of these parameters. For example, the pitch may be represented as a pitch period, a fundamental frequency or pitch frequency (which is the inverse of the pitch period), or as a long-term prediction delay. Similarly, the voicing state may be represented by one or more voicing metrics, by a voicing probability measure, or by a set of voicing decisions. The spectral envelope is often represented by an all-pole filter response, but also may be represented by a set of spectral magnitudes or other spectral measurements. Since they permit a speech segment to be represented using only a small number of parameters, model-based speech coders, such as vocoders, typically are able to operate at medium to low data rates. However, the quality of a model-based system is dependent on the accuracy of the underlying model. Accordingly, a high fidelity model must be used if these speech coders are to achieve high speech quality.

The MBE vocoder is a harmonic vocoder based on the MBE speech model that has been shown to work well in many applications. The MBE vocoder combines a harmonic representation for voiced speech with a flexible, frequency-dependent voicing structure based on the MBE speech model. This allows the MBE vocoder to produce natural sounding unvoiced speech and makes the MBE vocoder more robust to the presence of acoustic background noise. These properties allow the MBE vocoder to produce higher quality speech at low to medium data rates and have led to its use in a number of commercial mobile communication applications.

The MBE speech model represents segments of speech using a fundamental frequency corresponding to the pitch, a set of voicing metrics or decisions, and a set of spectral magnitudes corresponding to the frequency response of the vocal tract. The MBE model generalizes the traditional single V/UV decision per segment into a set of decisions, each representing the voicing state within a particular frequency band or region. Each frame is thereby divided into at least voiced and unvoiced frequency regions. This added flexibility in the voicing model allows the MBE model to better accommodate mixed voicing sounds, such as some voiced fricatives, allows a more accurate representation of speech that has been corrupted by acoustic background noise, and reduces the sensitivity to an error in any one decision. Extensive testing has shown that this generalization results in improved voice quality and intelligibility.

MBE-based vocoders include the IMBE™speech coder and the AMBE® speech coder. The IMBE™ speech coder has been used in a number of wireless communications systems including the APCO Project 25 mobile radio standard. The AMBE® speech coder is an improved system which includes a more robust method of estimating the excitation parameters (fundamental frequency and voicing decisions), and which is better able to track the variations and noise found in actual speech. Typically, the AMBE® speech coder uses a filter bank that typically includes sixteen channels and a nonlinearity to produce a set of channel outputs from which the excitation parameters can be reliably estimated. The channel outputs are combined and processed to estimate the fundamental frequency. Thereafter, the channels within each of several (e.g., eight) voicing bands are processed to estimate a binary voicing decision for each voicing band. In the AMBE+2™ vocoder, a three-state voicing model (voiced, unvoiced, pulsed) is applied to better represent plosive and other transient speech sounds. Various methods for quantizing the MBE model parameters have been applied in different systems. Typically the AMBE® vocoder and AMBE+2™ vocoder employ more advanced quantization methods, such as vector quantization, that produce higher quality speech at lower bit rates.

The encoder of an MBE-based speech coder estimates the set of model parameters for each speech segment. The MBE model parameters include a fundamental frequency (the reciprocal of the pitch period); a set of V/UV metrics or decisions that characterize the voicing state; and a set of spectral magnitudes that characterize the spectral envelope. After estimating the MBE model parameters for each segment, the encoder quantizes the parameters to produce a frame of bits. The encoder optionally may protect these bits with error correction/detection codes before interleaving and transmitting the resulting bit stream to a corresponding decoder.

The decoder in an MBE-based vocoder reconstructs the MBE model parameters (fundamental frequency, voicing information and spectral magnitudes) for each segment of speech from the received bit stream. As part of this reconstruction, the decoder may perform deinterleaving and error control decoding to correct and/or detect bit errors. In addition, the decoder typically performs phase regeneration to compute synthetic phase information. For example, in a method specified in the APCO Project 25 Vocoder Description and described in U.S. Pat. Nos. 5,081,681 and 5,664,051, random phase regeneration is used, with the amount of randomness depending on the voicing decisions. In another method, phase regeneration is performed by applying a smoothing kernel to the reconstructed spectral magnitudes as described in U.S. Pat. No. 5,701,390.

The decoder uses the reconstructed MBE model parameters to synthesize a speech signal that perceptually resembles the original speech to a high degree. Normally, separate signal components, corresponding to voiced, unvoiced, and optionally pulsed speech, are synthesized for each segment, and the resulting components are then added together to form the synthetic speech signal. This process is repeated for each segment of speech to reproduce the complete speech signal, which can then be output through a D-to-A converter and a loudspeaker. The unvoiced signal component may be synthesized using a windowed overlap-add method to filter a white noise signal. The time-varying spectral envelope of the filter is determined from the sequence of reconstructed spectral magnitudes in frequency regions designated as unvoiced, with other frequency regions being set to zero.

The decoder may synthesize the voiced signal component using one of several methods. In one method, specified in the APCO Project 25 Vocoder Description (EIA/TIA standard document IS102BABA, herein incorporated by reference), a bank of harmonic oscillators is used, with one oscillator assigned to each harmonic of the fundamental frequency, and the contributions from all of the oscillators is summed to form the voiced signal component. In another method, as described in co-pending U.S. patent application Ser. No. 10/046,666, filed Jan. 16, 2002, which is incorporated by reference, the voiced signal component is synthesized by convolving a voiced impulse response with an impulse sequence and then combining the contribution from neighboring segments with windowed overlap add. This second method has the advantage of being faster to compute since it does not require any matching of components between segments, and it has the further advantage that it can be applied to the optional pulsed signal component.

One particular example of an MBE based vocoder is the 7200 bps IMBE™ vocoder selected as a standard for the APCO Project 25 mobile radio communication system. This vocoder, described in the APCO Project 25 Vocoder Description, uses 144 bits to represent each 20 ms frame. These bits are divided into 56 redundant FEC bits (applied as a combination of Golay and Hamming codes), 1 synchronization bit and 87 MBE parameter bits. The 87 MBE parameter bits consist of 8 bits to quantize the fundamental frequency, 3-12 bits to quantize the binary voiced/unvoiced decisions, and 67-76 bits to quantize the spectral magnitudes. The resulting 144 bit frame is transmitted from the encoder to the decoder. The decoder performs error correction decoding before reconstructing the MBE model parameters from the error-decoded bits. The decoder then uses the reconstructed model parameters to synthesize voiced and unvoiced signal components which are added together to form the decoded speech signal.

Subsequent to the development of the APCO Project 25 communication system, several advances in vocoder technology have been developed. These advanced methods allow new MBE-based vocoders to achieve higher voice quality at lower bit rates. For example, a state of the art MBE vocoder operating at 3600 bps can provide better performance than the standard 7200 bps APCO Project 25 vocoder even though it operates at half the data rate. The much lower data rate for the half-rate vocoder can provide much better communications efficiency (i.e., the amount of RF spectrum required for transmission) compared to the standard full-rate vocoder. However, use of a half-rate vocoder (or any other vocoder which is not bit stream compatible with the standard vocoder) in second generation radio devices creates interoperability issues if they have to communicate to existing radios that use the standard full-rate vocoder. In order to provide interoperability between the two radios using different vocoders, the system infrastructure (i.e., the base station or repeater) must convert or transcode between the two different vocoders. The traditional method of performing this conversion is to receive the encoded bit stream from the first radio, decode the bit stream back into a speech signal using the appropriate decoder, re-encode this speech signal back to a bit stream using the second encoder and then transmit the re-encoded bit stream to the second radio. This process is commonly referred to as tandem transcoding or tandeming, because the net effect is that both vocoders are applied back-to-back (i.e., in tandem).

An alternative digital-to-digital conversion method is presented in the context of a multi-speaker conferencing system in U.S. Pat. Nos. 5,383,184, 5,272,698, 5,457,685 and 5,317,567. This system includes a conferencing bridge that may interface vocoders operating at different bit rates without tandeming. In this application, the conferencing bridge measures the bit rate associated with each of several users, combines and converts all the bit streams, and sends the results back to each user at their particular bit rate. The bit rate conversion process in the conferencing bridge operates by reencoding the cepstral coefficients that represent the spectral envelope for each frame.

SUMMARY

In one general aspect, a parametric voice transcoder converts an input bit stream produced by a first voice encoder unit into an output bit stream that can be decoded by a second voice decoder unit, where the first voice encoder unit is at least partially incompatible with the second voice decoder unit. The transcoder provides interoperability between two different vocoders without significantly degrading voice quality.

In one implementation, the parametric voice transcoder converts between two incompatible MBE vocoders. An input bit stream produced by a first MBE encoder unit is converted into an output bit stream that can be decoded by a second MBE decoder unit that is incompatible with the first MBE encoder unit. The parametric transcoder unit reconstructs MBE model parameters from the input bit stream, converts the MBE parameters as needed, and then quantizes the converted MBE model parameters to produce the output bit stream. In one such implementation, an input bit stream that is compatible with a half-rate MBE decoder is converted into an output bit stream that is compatible with a full-rate MBE decoder. In another such implementation, an input bit stream that is compatible with a full-rate MBE decoder is converted into an output bit stream that is compatible with a half-rate MBE decoder. The full-rate MBE vocoder may be a 7200 bps MBE vocoder that is compatible with the APCO Project 25 Vocoder standard. The half-rate vocoder may be a 3600 bps MBE vocoder.

Other features will be apparent from the following description, including the drawings, and the claims.

DETAILED DESCRIPTION

A general technique for converting between the bit streams of two or more different vocoders provides interoperability between the different vocodersA described implementation employs a MBE transcoder in the context of converting between a full-rate 7200 bps MBE vocoder, such as the standard vocoder for the APCO Project 25 communication system, and a new 3600 bps half-rate MBE vocoder designed for use in next -generation mobile radio equipment.

Figure 1:
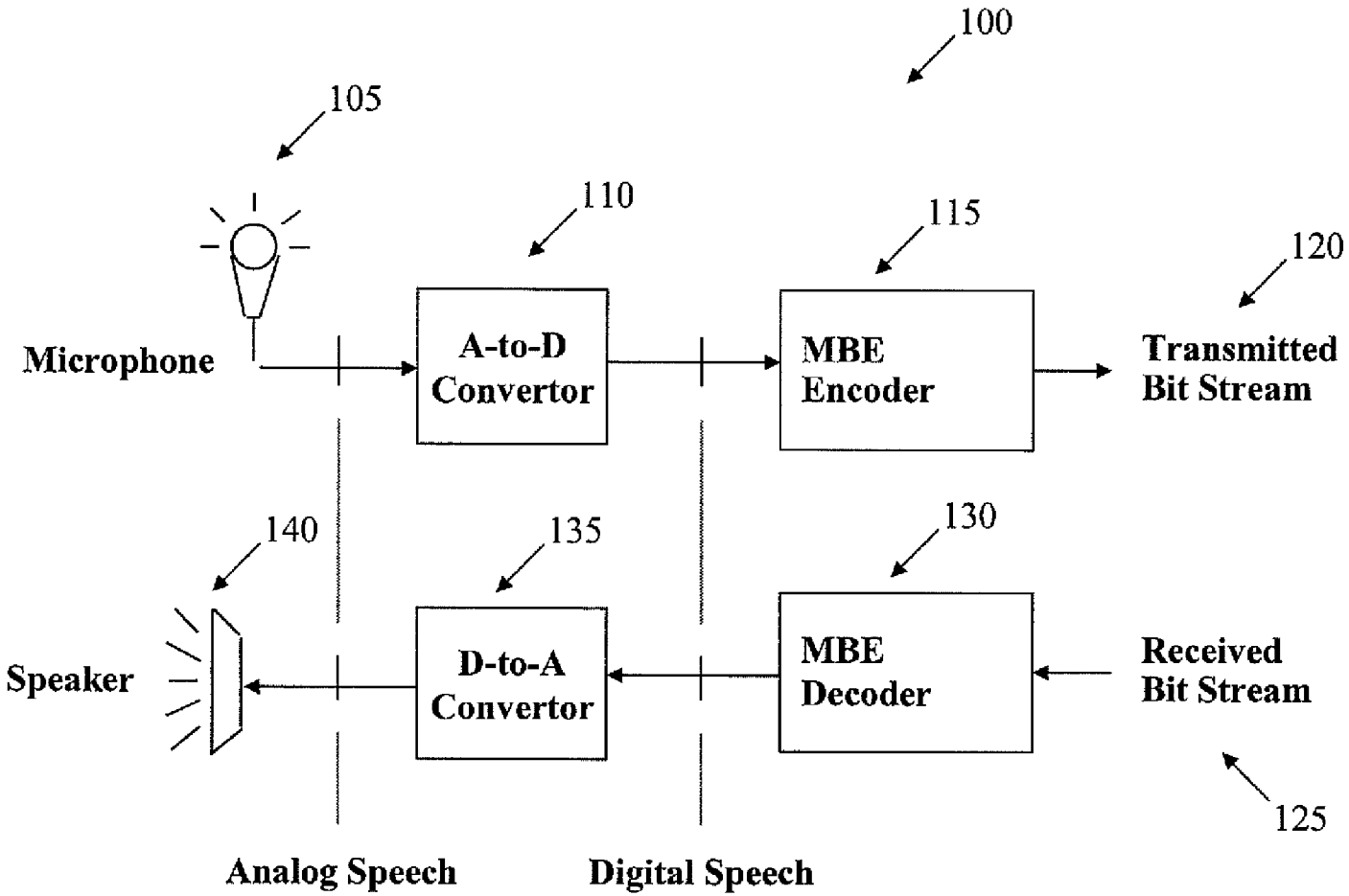
FIG. 1 is a block diagram of an application of an MBE vocoder.

FIG. 1 shows a speech coder or vocoder system 100 that samples analog speech or some other signal from a microphone 105. An A-to-D converter 110 digitizes the sampled speech to produce a digital speech signal. The digital speech is processed by a MBE speech encoder unit 115 to produce a digital bit stream 120 suitable for transmission or storage. Typically, the speech encoder processes the digital speech signal in short frames, where the frames may be further divided into one or more subframes. Each frame of digital speech samples produces a corresponding frame of bits in the bit stream output of the encoder. If there is only one subframe in the frame, then the frame and subframe typically are equivalent and refer to the same partitioning of the signal. In one implementation, the frame size is 20 ms in duration and consists of 160 samples at a 8 kHz sampling rate. Performance may be increased in some applications by dividing each frame into two 10 ms subframes.

FIG. 1 also depicts a received bit stream 125 entering a MBE speech decoder unit 130 that processes each frame of bits to produce a corresponding frame of synthesized speech samples. A D-to-A converter unit 135 then converts the digital speech samples to an analog signal that can be passed to a speaker unit 140 for conversion into an acoustic signal suitable for human listening.

Figure 2:
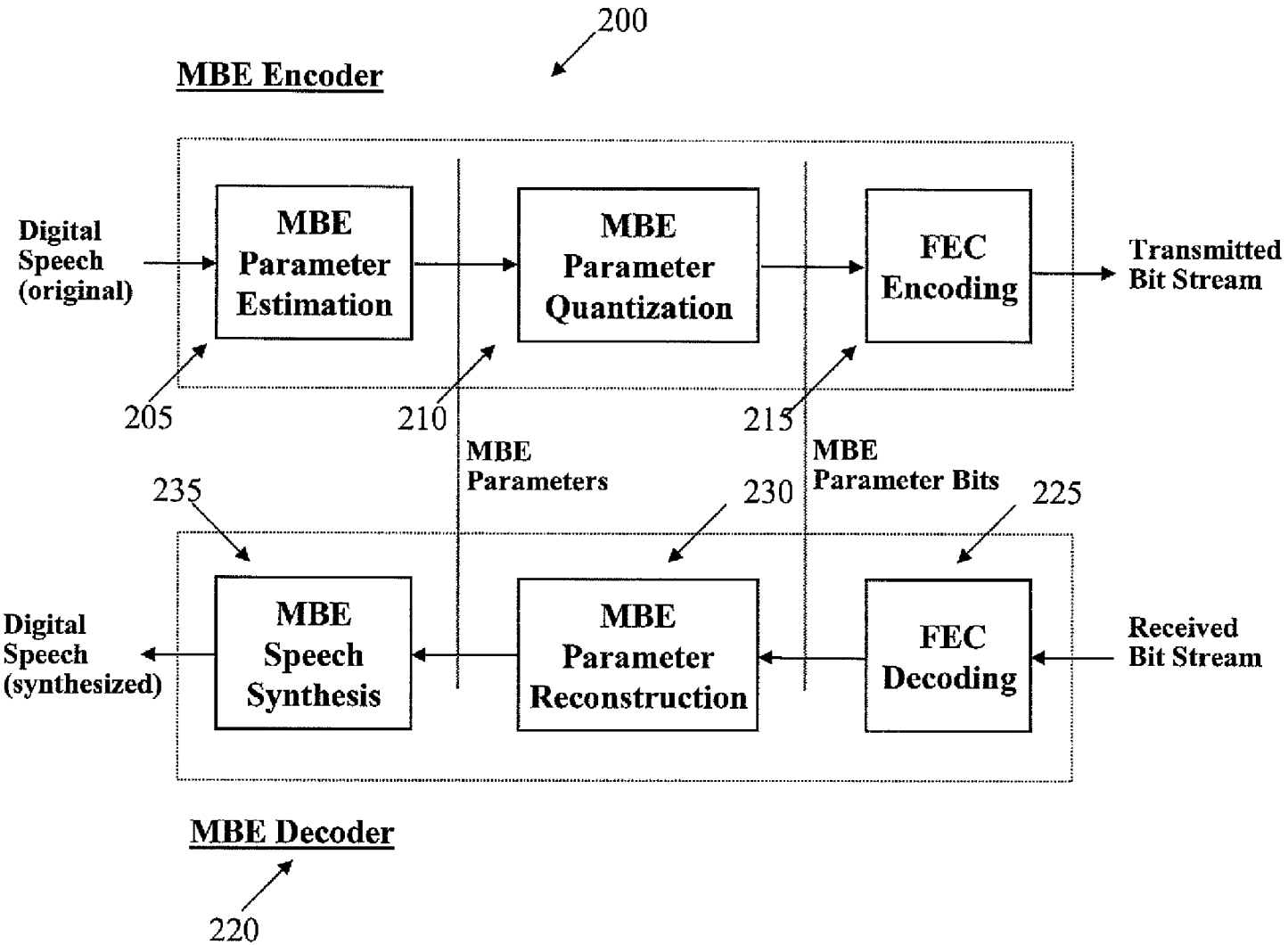
FIG. 2 is a block diagram of an MBE vocoder including an encoder and a decoder.

FIG. 2 shows a MBE vocoder that includes an MBE encoder unit 200 that employs a parameter estimation unit 205 to estimate generalized MBE model parameters for each frame. These estimated model parameters for a frame then are quantized by a parameter quantization unit 210 to produce parameter bits that are fed to a FEC Encoding unit 215 that combines the quantized bits with redundant forward error correction (FEC) data to form the transmitted bit stream. The addition of redundant FEC data enables the decoder to correct and/or detect bit errors caused by degradation in the transmission channel. The FEC encoding unit 215 also may include data dependent scrambling and/or interleaving to further improve performance in noisy channels.

As also shown in FIG. 2, the MBE vocoder includes a MBE decoder unit 220 that processes a frame of bits in the received bit stream with a FEC decoding unit 225 to correct and/or detect bit errors. The FEC encoding unit may also include data dependent descrambling and/or deinterleaving to further improve performance in noisy channels. The parameter bits for the frame output by the FEC decoding unit 225 then are processed by a parameter reconstruction unit 230 that reconstructs MBE model parameters for each frame. The resulting MBE model parameters then are used by a speech synthesis unit 235 to produce a synthetic digital speech signal that is the output of the decoder.

Techniques are provided for converting between two or more incompatible vocoders, such as two MBE vocoders operating at different bit rates or having other incompatibilities (for example, incompatibilities caused by the use of different FEC, quantization and/or reconstruction elements). In one implementation, the techniques convert between a full-rate 7200 bps MBE vocoder that is compatible with the APCO Project 25 vocoder standard and a half-rate 3600 bps MBE vocoder that is designed for use in next-generation mobile radio equipment. While the techniques are described in the context of converting between these two specific vocoders, the techniques are widely applicable to many different bit rates and vocoder variants beyond the specific example given above. The use of the terms "full-rate" and "half-rate" are only used for notational convenience, and are not meant to indicate that the bit rates processed by the techniques must be related by a multiple of two, nor is there intended to be a restriction that the full-rate vocoder must have a higher bit rate than the half-rate vocoder. For example, the techniques would be equally applicable to converting between a 6400 bps MBE "half-rate" vocoder and a 4800 bps "full-rate" vocoder. In addition, the techniques are applicable even if the bit rates are not different, such as, for example, in the context of converting between an older 4000 bps MBE vocoder and a newer 4000 bps MBE vocoder. A 6400 bps MBE vocoder that can be used in conjunction with the techniques is described in U.S. Pat. No. 5,491,772, which is incorporated by reference.

The APCO Project 25 vocoder standard is a 7200 bps IMBE™ vocoder that uses 144 encoded voice bits to represent each 20 ms frame of speech. Each frame of 144 bits includes 56 redundant FEC bits, 1 synchronization bit and 87 MBE parameter bits. The redundant FEC bits are formed from a combination of 4[23,12] Golay codes and 3[15,11] Hamming codes. The APCO Project 25 vocoder also includes data dependent scrambling which scrambles a particular subset of each frame of 144 bits based on a modulation key that is derived from the most sensitive 12 bits of the frame. Interleaving of the FEC codewords within a frame is used to reduce the effect of burst errors.

In order to be interoperable with the APCO Project 25 vocoder standard, a vocoder must meet certain requirements described in the APCO Project 25 Vocoder Description and relating to the specific bits that are transmitted between the encoder and the decoder. For example, the MBE model parameter quantization/reconstruction and FEC encoding/decoding must closely follow the requirements set out in the standard description in order to achieve interoperability. Other elements of the vocoder, such as the method for estimating the MBE model parameter, and/or the method for synthesizing speech from the model parameters, can be implemented as described in the standard description, or other enhanced methods can be employed to improve performance while still remaining interoperable with the standard defined bit stream (see co-pending U.S. application Ser. No. 10/292,460, filed Nov. 13, 2002 and entitled "Interoperable Vocoder," which is incorporated by reference).

A half-rate 3600 bps MBE vocoder has been developed for use in next generation radio equipment. This half-rate vocoder uses a frame having 72 bits per 20 ms, with the bits divided into 23 FEC bits and 49 MBE parameter bits. The 23 FEC bits comprise one [24,12] extended Golay code and one [23,12] Golay code. The FEC bits protect the 24 most sensitive bits of the frame and can correct and/or detect certain bit error patterns in these protected bits. The remaining 25 bits are not protected since they are less sensitive to bit errors. To increase the ability to detect bit errors in the most sensitive bits, data dependent scrambling is applied to the [23,12] Golay code based on a modulation key generated from the first 12 bits. A [4×18] row-column interleaver is also applied to reduce the effect of burst errors. The 49 MBE parameter bits are divided into 7 bits to quantize the fundamental frequency, 5 bits to vector quantize the voicing decisions over 8 frequency bands, and 37 bits to quantize the spectral magnitudes.

Figure 3:
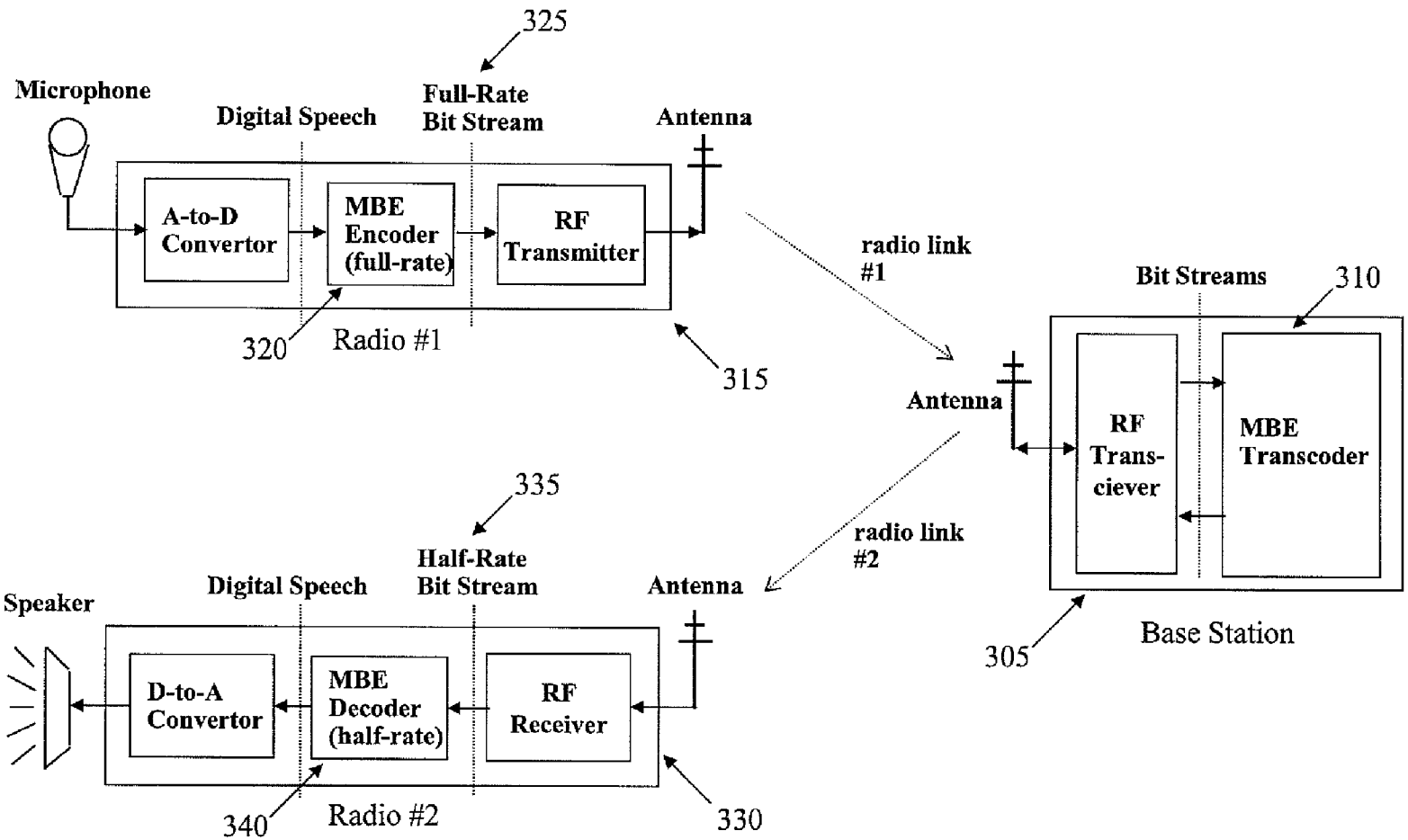
FIG. 3 is a block diagram showing an application of an MBE transcoder.

As shown in FIG. 3, the techniques may be implemented using an MBE transcoder 310 operating in a radio base station 305 to provide interoperability between two normally incompatible radios. A first radio 315 includes a full-rate MBE encoder 320 that processes speech to produce a full-rate bit stream 325 that is transmitted from the first radio to the base station. The base station receives the full-rate bit stream from the first radio and processes the bit stream using MBE transcoder unit 310 to produce an output bit stream that is transmitted to a second radio unit 330 and is compatible with a half-rate MBE decoder 340 in the second radio unit 330. At the second radio unit, the half-rate MBE decoder unit 340 converts the received half-rate bit stream 335 to speech.

The two radios 315 and 330 use incompatible vocoders and hence they are not able to directly communicate, since the half-rate MBE decoder 340 in the second radio 330 is unable to decode speech from the full-rate bit stream 325 generated by the full-rate MBE encoder unit 320 in the first radio 315. However, the MBE transcoder unit 310 converts the received full-rate bit stream into a half-rate bit stream to enable high quality communications between these two normally incompatible radios. Note that while the transcoder is depicted as converting from a full-rate MBE encoder to a half-rate MBE decoder, the transcoder also operates in reverse to provide communications between a half-rate MBE encoder in the second radio and a full-rate MBE decoder in the first radio. In this reverse direction, the MBE transcoder receives a half-rate bit stream from the second radio and converts that bit stream to a full-rate bit stream for transmission to the first radio. The description provided here is generally applicable to either direction of operation.

Figure 4:
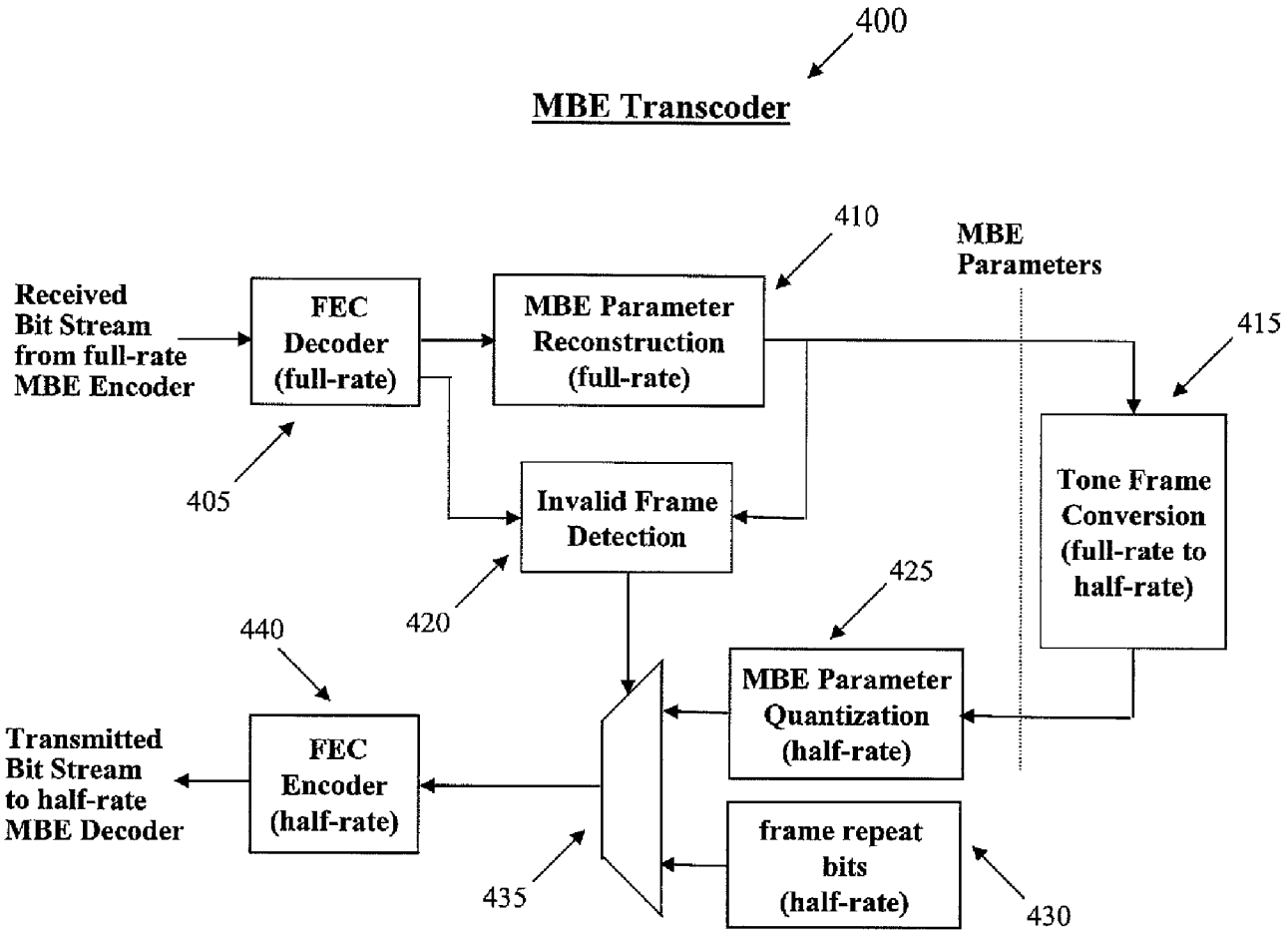
FIG. 4 is a block diagram of an MBE transcoder.

FIG. 4 shows a block diagram of a particular implementation 400 of the MBE transcoder unit 310 shown in FIG. 3. As shown, the transcoder 400 includes a full-rate FEC decoder unit 405 that receives a full-rate bit stream, performs FEC decoding and outputs the MBE parameter bits. The FEC decoding for the full-rate APCO Project 25 vocoder consists of deinterleaving and decoding the set of Golay and Hamming codes, applying data dependent descrambling to all but the first Golay code, and updating a set of channel quality metrics such as the total number of corrected bit errors and the local estimated bit error rate.

The MBE parameter bits then are processed by MBE parameter reconstruction unit 410, which outputs reconstructed MBE parameters (fundamental frequency, voicing decisions and log spectral magnitudes) for each vocoder frame. In the event that the reconstructed MBE parameters represent a tone signal, an optional tone conversion unit 415 may be applied to convert the reconstructed MBE parameters to the tone representation used by the half-rate vocoder as further described below. For non-tone signals, the MBE parameters are generally passed through the tone conversion unit 415 without modification, although any other differences or incompatibilities between the full-rate and half-rate vocoders can be accounted for in this element. The resulting MBE parameters are then quantized in the half-rate MBE quantization unit 425 and the resulting half-rate MBE parameter bits are sent to selection unit 435.

The MBE transcoder also features an invalid frame detection unit 420 that inputs the updated channel quality metrics from FEC decoder unit 405 and MBE parameters from MBE parameter reconstruction unit 410 to determine if each frame is valid or invalid. A frame may be designated as invalid if the frame contains too many corrected or detected bit errors, or if an invalid fundamental frequency is reconstructed for the frame. Otherwise, the frame is designated as valid.

If the frame is designated as valid, the selection unit 435 sends the half-rate MBE parameter bits from the half-rate MBE quantization unit 425 to a half-rate FEC encoding unit 440. Otherwise, if the frame is designated as invalid, then known frame repeat bits from a frame repeat unit 430 are sent by selection unit 435 to the half-rate FEC encoding unit 440.

The known frame repeat bits consist of a known frame of 72 bits which will be interpreted by a subsequent half-rate MBE decoder as an invalid frame and will thereby force a frame repeat.

The half-rate FEC encoding unit inputs the selected parameter bits and performs half-rate FEC encoding to output a half-rate bit stream that is suitable for transmission to a half-rate MBE decoder. In one implementation, the half-rate FEC encoder includes one [24,12] extended Golay code followed by one [23,12] Golay code and applies data dependent scrambling to the second Golay code using a modulation key generated from the 12 input bits of the first extended Golay code. Interleaving is then used to combine the Golay codewords with the unprotected data.

The purpose of the tone conversion unit 415 is to convert the reconstructed MBE parameters to the appropriate representation used in the half-rate coder if the current frame corresponds to a tone signal. The first step in this process is to check whether the current frame corresponds to a reserved tone signal, such as a single frequency tone, a DTMF tone, a call progress tone or a Knox tone. In some MBE vocoders, such as the APCO Project 25 vocoder, tone signals may be represented using regular voice frames, where the fundamental frequency is selected appropriately and where one or two of the spectral magnitudes are large and voiced while the other spectral magnitudes are smaller and generally unvoiced. This approach is described in co-pending U.S. application Ser. No. 10/292,460, titled "Interoperable Vocoder." In this class of MBE vocoder, tone conversion unit 415 can detect tone signals by determining whether the reconstructed spectral magnitudes have these properties. In other MBE vocoders, such as the proposed 3600 bps half-rate vocoder for APCO Project 25, tone signals are represented using a special reserved fundamental frequency which is only used for tone signals and not voice signals. In this case, tone signals are easily identified by checking whether the reconstructed fundamental frequency is equal to the reserved value. If a tone signal is detected, then tone conversion unit 415 must convert from the tone representation used in the full-rate vocoder to the tone representation used in the half-rate vocoder (or vice-versa when transcoding in the reverse direction). If a tone signal is not detected, then no conversion is applied.

Figure 5:
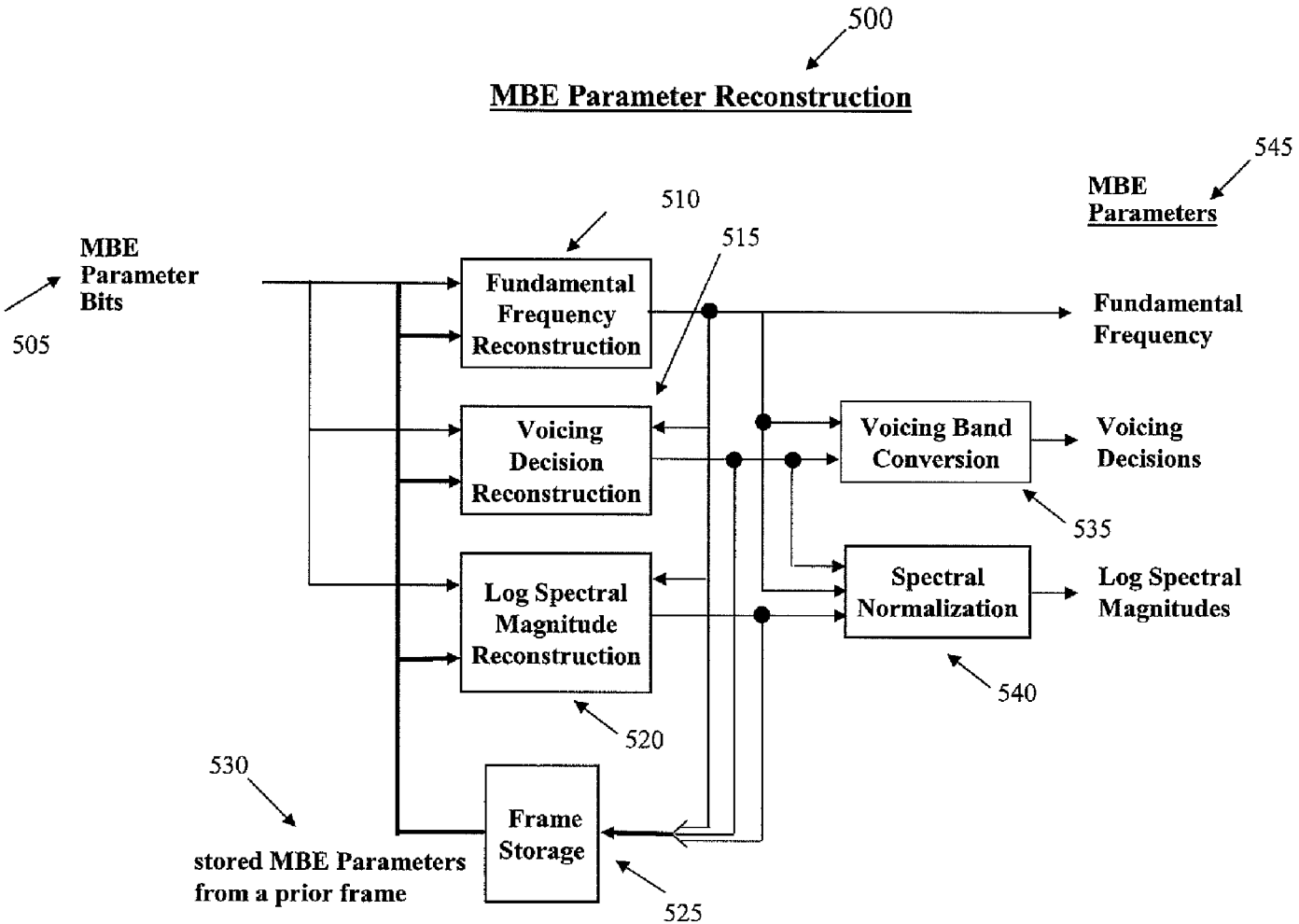
FIG. 5 is a block diagram illustrating a MBE parameter reconstruction technique.

FIG. 5 illustrates an MBE parameter reconstruction technique 500, such as may be implemented as element 410 in the MBE transcoder shown in FIG. 4. MBE parameter bits 505 from an FEC decoder unit 405 are input and used to reconstruct a set of MBE model parameters for each frame of speech. MBE model parameters for a frame typically include a fundamental frequency reconstructed by element 510, a set of voicing decisions reconstructed by element 515, and a set of log spectral magnitudes reconstructed by element 520.

To simplify later processing steps, a voicing band conversion element 535 maps the reconstructed voicing decisions to a fixed number (N=8 is typical) of voicing bands. For example, in the APCO Project 25 vocoder, a variable number of voicing decisions (3 to 12) are reconstructed depending on the fundamental frequency, where one voicing decision is typically used for every block of 3 harmonics. In this case, the voicing band conversion unit 535 may resample the voicing decisions to produce a fixed number (e.g., 8) of voicing decisions from the variable number of voicing decisions. Typically, this resampling process favors the voiced state over other (i.e., unvoiced or optionally pulsed) states, and does so by selecting the voiced state whenever the original voicing decision is voiced on either side of the resampling point. In applications where the reconstructed voicing decisions from element 515 already consist of the desired fixed number of voicing decisions, the voicing band conversion unit 535 may simply pass the reconstructed voicing decisions through without modification. Alternative implementations may be designed around a variable number of voicing decisions, in which case voicing band conversion unit 535 may not be required.

FIG. 5 also contains a spectral normalization unit 540 to permit modification of the log spectral magnitudes output from log spectral magnitude reconstruction unit 520. In some MBE vocoders (such as the APCO Project 25 vocoder), the scaling of the spectral magnitudes is different between voiced and unvoiced bands. To simplify later processing steps in the MBE transcoder, spectral normalization unit 540 removes this difference by compensating the reconstructed log spectral magnitudes in unvoiced bands. Since scaling differences are equivalent to an offset in the logarithmic domain, spectral normalization unit 540 adds an offset given by $0.5\times\log(256\times f_0)$ where $f_0$ is the reconstructed fundamental frequency from element 510. In applications where there are no scaling differences in the spectral magnitudes or in alternative implementations designed to accommodate these differences, spectral normalization unit 540 may not be included.

The reconstruction of the MBE parameters for a frame generally uses reconstructed MBE parameters from a prior frame to improve voice quality. Reconstructed parameters 545 are output and simultaneously stored for a frame in frame storage unit 525. The output of the frame storage unit 525 is the reconstructed MBE parameters for a previous frame. These previous parameters are applied to reconstruction units 510, 515 and 520. In the illustrated implementation, stored MBE parameters from a prior frame are used in log spectral magnitude reconstruction unit 520 as shown in the shaded portion of FIG. 7 to reconstruct the log spectral magnitudes of the current frame.

Figure 6:
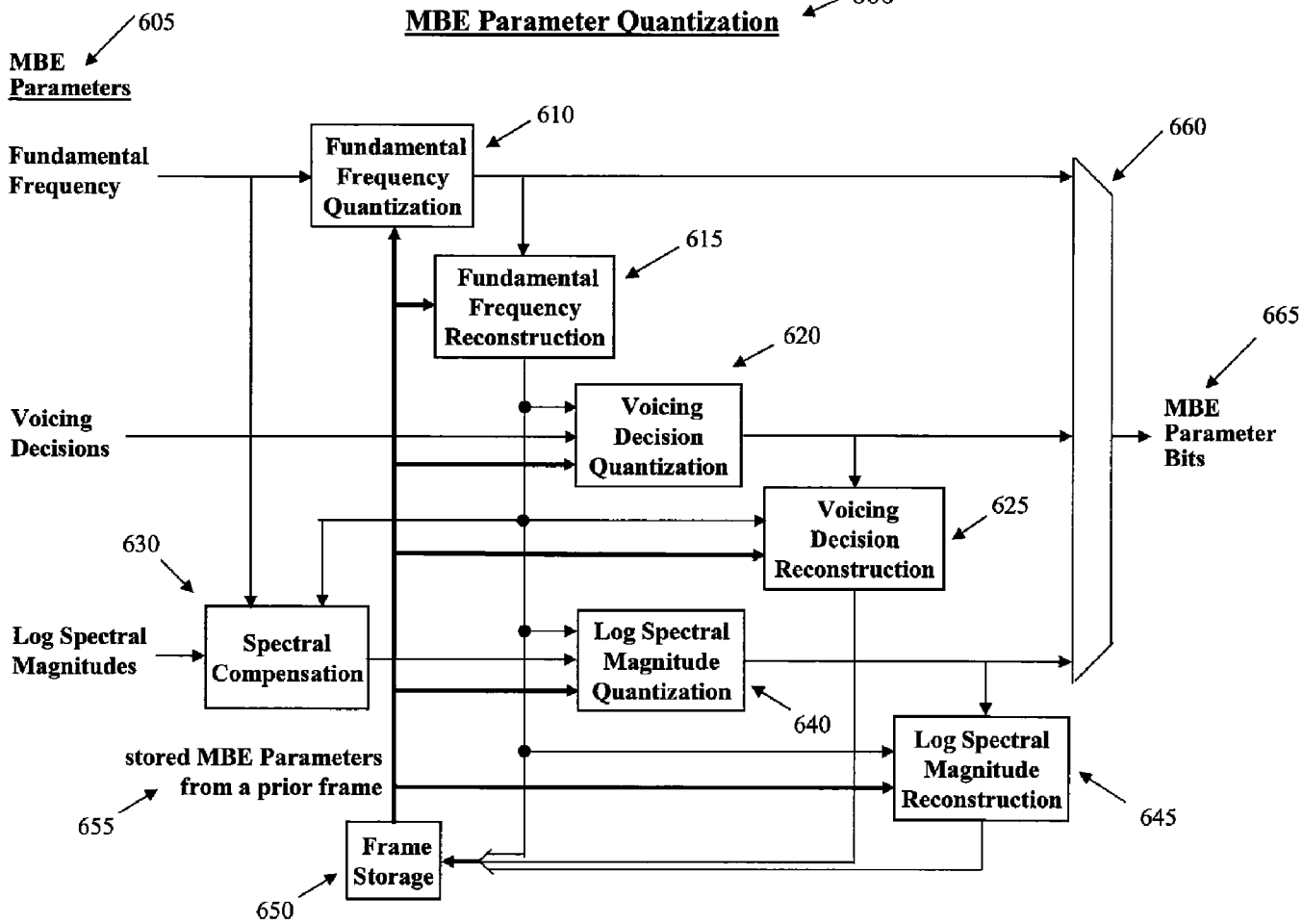
FIG. 6 is a block diagram illustrating a MBE parameter quantization method.

FIG. 6 illustrates a corresponding MBE parameter quantization method 600 that may be used to implement element 425 in the MBE transcoder shown in FIG. 4. MBE parameters 605, such as may be produced by MBE reconstruction unit 410 or MBE parameter conversion unit 415, are the inputs to the MBE parameter quantization method. The fundamental frequency is quantized for a frame in quantization unit 610. The resulting fundamental frequency parameter bits are then input to a fundamental frequency reconstruction unit 615 that outputs the reconstructed fundamental frequency.

Next, the voicing decisions for a frame are applied to a quantization unit 620 to produce output voicing parameter bits which are applied to a voicing decision reconstruction unit 625 to produce reconstructed voicing decisions.

The log spectral magnitudes are input to a spectral compensation unit 630 that compensates the log spectral magnitude to account for any significant difference between the input fundamental frequency and the reconstructed fundamental frequency output from reconstruction unit 615 as further described below. The compensated log spectral magnitudes output from spectral compensation unit 630 are applied to a log spectral magnitude quantization unit 640 to produce log spectral magnitude parameter bits which are applied to a log spectral magnitude reconstruction unit 645 to produce the reconstructed log spectral magnitudes.

The fundamental frequency, voicing and log spectral magnitude parameter bits output by quantization units 610, 620 and 640, respectively, are also sent to a combiner unit 660 that combines these parameter bits for each frame to output MBE parameter bits 665.

The reconstructed fundamental frequency, voicing decisions and log spectral magnitudes output by reconstruction units 615, 625, and 645, respectively, are applied to a frame storage unit 650 that outputs the reconstructed MBE parameters from a prior frame 655. These prior frame parameters 655 are sent to the quantization and reconstruction units where they are generally used in some or all of these quantization units to improve voice quality. In one implementation, MBE parameters from a prior frame are used in log spectral magnitude quantization unit 640, which may be constructed as shown in FIG. 7, where the shaded portion shows the corresponding log spectral magnitude reconstruction unit 645 for this implementation.

The fundamental frequency quantization and reconstruction process, shown as elements 610 and 615 of FIG. 6, generally introduces some quantization error into the reconstructed fundamental frequency relative to the input fundamental frequency. In a typical MBE vocoder, the spectral magnitudes represent the speech spectrum at each harmonic of the fundamental frequency. Accordingly, this quantization error in the fundamental frequency will introduce a frequency scaling error into the speech spectrum. This error, if too large, may cause significant reductions in speech intelligibility and quality. To alleviate this problem, spectral compensation unit 630 is typically applied to remap the log spectral magnitudes if the fundamental frequency quantization error exceeds 1%, and, otherwise, to output the log spectral magnitudes without modification. When compensation is applied, the log spectral magnitudes are linearly interpolated and resampled based on the ratio, R, of the reconstructed fundamental frequency over the input fundamental frequency. In addition, an offset equal to $0.5\times \log(R)$ is added to each spectral magnitude to preserve the total energy. The result is that the log spectral magnitudes output from spectral compensation unit 630 are compensated for any significant quantization error introduced into the fundamental frequency by quantization unit 610 and reconstruction unit 615 in order to preserve voice quality and intelligibility.

In general, the methods used within each of the quantization units shown in FIG. 6 and within each of the reconstructions units shown in FIGS. 5 and 6 are determined by the specifications for the respective full-rate and half-rate MBE vocoders to which the MBE transcoder is being applied. In the MBE transcoder application shown in FIG. 4, where the MBE transcoder converts a received full-rate MBE bit stream to a half-rate MBE bit stream, the MBE parameter reconstruction method 500 shown in FIG. 5 would reconstruct the MBE parameters by inverting the quantization steps as specified for the full-rate encoder. Similarly, in this application, the MBE parameter quantization method 600 would quantize the MBE parameters by applying the quantization steps as specified for the half-rate encoder. The voicing band conversion unit 535 and the spectral normalization unit 540 are typically included in the MBE transcoder reconstruction process, even though they may not be part of the full-rate vocoder specification used in a radio such as the radio unit 325 of FIG. 3. The utility of these optional elements in the MBE transcoder is that they simplify the subsequent quantization method shown in FIG. 6 by converting the format of the voicing decisions and the log spectral magnitudes.

Figure 7:
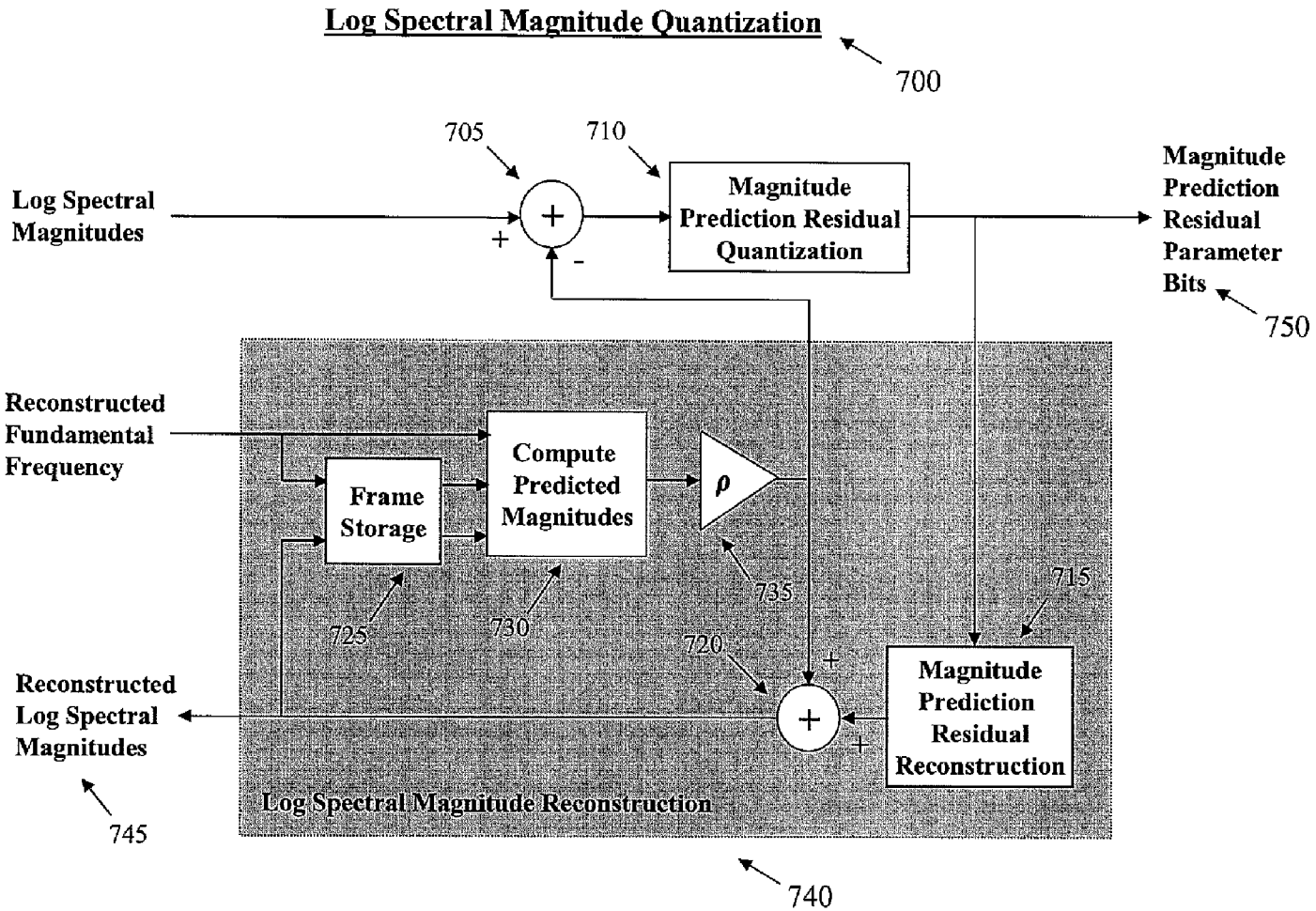
FIG. 7 is a block diagram of a log spectral magnitude quantization and reconstruction process.

FIG. 7 shows an implementation of a log spectral magnitude quantization method 700 that uses MBE parameters from a prior frame and corresponds to quantization unit 640 of FIG. 6. The shaded section of FIG. 7, including elements 715-735, shows a corresponding implementation of a log spectral magnitude reconstruction method 740 as may be used in unit 520 of FIG. 5 and unit 645 of FIG. 6. Referring to FIG. 7, log spectral magnitudes for a frame are applied to a difference unit 705 that subtracts predicted magnitudes to compute a set of magnitude prediction residuals. The magnitude prediction residuals are input to a quantization unit 710 that determines magnitude prediction residual parameter bits 750 which form an output of the quantization method 700.

The output parameter bits 750 are also fed to the reconstruction method 740 depicted in the shaded region of FIG. 7. in particular, a magnitude prediction residual reconstruction unit 715 computes reconstructed magnitude prediction residuals using the bits 750 and outputs these to a summation unit 720 that adds the predicted magnitudes to form reconstructed log spectral magnitudes 745. The reconstructed log spectral magnitudes 745 are outputs of the log spectral magnitude reconstruction method and are stored in a frame storage element 725.

The reconstructed log spectral magnitudes stored from a prior frame are processed in conjunction with reconstructed fundamental frequencies for the current and prior frames by predicted magnitude computation unit 730 and then scaled by a scaling unit 735 to form predicted magnitudes that are applied to difference unit 705 and summation unit 720.

Predicted magnitude computation unit 730 typically interpolates the reconstructed log spectral magnitudes from a prior frame based on the ratio of the reconstructed fundamental frequency from the current frame to the reconstructed fundamental frequency of the prior frame. This interpolation is followed by application by scaling unit 735 of a scale factor $\rho$ that normally is less than 1.0 ($\rho$=0.65 is typical) and that, in some implementations, may be varied depending on the number of spectral magnitudes in the frame. Further details on a specific implementation of the MBE parameter quantization and reconstruction methods that may be used are given in the APCO Project 25 Vocoder Description.

While the techniques are described largely in the context of the APCO Project 25 communication system, and the standard 7200 bps MBE vocoder used in this system, the described techniques may be readily applied to other systems and/or vocoders. For example other existing communication systems (e.g., FAA NEXCOM, Inmarsat, and ETSI GMR) that use MBE type vocoders may also benefit from the techniques. In addition, the techniques described may be applicable to many other speech coding systems that operate at different bit rates or frame sizes, or use a different speech model with alternative parameters (such as STC, MELP, MB-HTC, CELP, HVXC or others) or which use different methods for analysis, quantization and/or synthesis. Other implementations are within the scope of the following claims.

What is claimed is:

1. An apparatus for converting a sequence of first encoded voice bits into a sequence of second encoded voice bits, the apparatus comprising:

a receiver configured to receive first encoded voice bits;

a transcoder connected to receive the first encoded voice bits from the receiver and operable to:

divide the first encoded voice bits into one or more received frames, with each received frame containing multiple ones of the first encoded voice bits, compute first parameter bits for at least one of the received frames by to applying error control decoding to one or more of the encoded voice bits contained in the received frame, compute speech parameters from the first parameter bits, quantize the speech parameters to produce second parameter bits, determine whether the at least one of the received frames is invalid, if the at least one of the received frames is invalid, substitute invalid frame bits for the second parameter bits, form a transmission frame by applying error control encoding to one or more of the second parameter bits or the invalid frame bits, and include the transmission frame in second encoded voice bits; and a transmitted connected to receive the second encoded voice bits from the transcoder and to transmit the second encoded voice bits.

2. The apparatus of claim 1 wherein the speech parameters include a fundamental frequency or pitch parameter, one or more voicing parameters and a set of spectral parameters.

3. The apparatus of claim 2 wherein the voicing parameters include a set of voicing decisions, with each voicing decision representing the voicing state in one of several frequency bands.

4. The apparatus of claim 3 wherein the voicing decisions determine whether the voicing state of a frequency bands is voiced, unvoiced or pulsed.

5. The apparatus of claim 2 wherein the speech parameters are at least in part based on the MultiBand Excitation (MBE) speech model.

6. The apparatus of claim 1 wherein the number of first encoded voice bits contained with a received frame is not equal to the number of second encoded voice bits contained in the transmission frame.

7. The apparatus of claim 1 wherein the transcoder is operable to determine whether a received frame is invalid based in part on error control decoding information.

8. The apparatus of claim 1 wherein the transcoder is operable to compute speech parameters from the first parameter bits by storing one or more speech parameters from a prior frame and using the stored speech parameters at least in part to compute the speech parameters for a later frame.

9. The apparatus of claim 8 wherein the transcoder is operable to quantize the speech parameters to produce second parameter bits by storing speech parameters from a previous frame and using the stored speech parameters during quantization of the speech parameters for a current frame.

10. The apparatus of claim 1 wherein the transcoder is operable to quantize the speech parameters to produce second parameter bits by storing speech parameters from a previous frame and using the stored speech parameters during quantization of the speech parameters for a current frame.

11. The apparatus of claim 10 wherein the speech parameters for a frame include spectral magnitudes parameters, and the transcoder is operable to store the spectral magnitudes parameters from the previous frame and use the stored spectral magnitude parameters to compute and/or quantize the spectral magnitudes parameters for the current frame.

12. The apparatus of claim 11 wherein the speech parameters for a frame include a fundamental frequency parameter, and the transcoder is operable to store the fundamental frequency parameter from the previous frame and use the stored fundamental frequency parameter to compute and/or quantize the spectral magnitude parameters for the current frame.

13. The apparatus of claim 12 wherein the transcoder is operable to compute the spectral magnitudes parameters for the current frame by:

computing a set of predicted magnitudes from the stored spectral magnitude parameters from the previous frame;

reconstructing spectral magnitude prediction residuals from the first parameter bits; and combining the predicted magnitudes with the spectral magnitude prediction residuals to form the spectral magnitude parameters for the current frame.

14. The apparatus of claim 13 wherein the transcoder is operable to compute the predicted magnitudes by interpolating and resampling the stored spectral magnitude parameters from a previous frame based on the fundamental frequency of the current frame and the stored fundamental frequency of the previous frame.

15. The apparatus of claim 14 wherein the received frame is interoperable with a standard vocoder used in APCO Project 25.

16. The apparatus of claim 14 wherein the transmission frame is interoperable with a standard vocoder used in APCO Project 25.

17. A transcoder operable to convert a sequence of first encoded voice bits into a sequence of second encoded voice bits by:

dividing the sequence of first voice bits into one or more input frames, with each of the input frames containing multiple ones of the first voice bits;

reconstructing speech parameters for one or more of the input frames, wherein:

the transcoder stores the speech parameters reconstructed for a previous frame and uses the stored speech parameters reconstructed for a previous frame during reconstruction of the speech parameters for a later frame, the speech parameters include a set of spectral magnitude parameters, and the transcoder reconstructs spectral magnitude parameters for the later frame by:

computing a set of predicted magnitudes from spectral magnitude parameters stored from the previous frame;

reconstructing spectral magnitude prediction residuals from the later frame; and combining the predicted magnitudes with the spectral magnitude prediction residuals to form the spectral magnitude parameters for the later frame;

processing the speech parameters to produce an output frame of bits; and combining one or more of the output frames to form a sequence of second encoded voice bits.

18. The apparatus of claim 17 wherein the transcoder is operable to reconstruct speech parameters by applying error control decoding to an input frame.

19. The apparatus of claim 17 wherein the speech parameters include a parameter conveying pitch information, a parameter indicating the voicing state, and the set of spectral magnitude parameters.

20. The apparatus of claim 19 wherein the speech parameters include a fundamental frequency parameter conveying pitch information, a set of voicing decisions that indicate the voicing state in multiple frequency bands, and the set of spectral magnitude parameters.

21. The apparatus of claim 20 wherein the transcoder is operable to compute the predicted magnitudes by interpolating and resampling the stored spectral magnitude parameters from the previous frame based on the fundamental frequency of the later frame and the stored fundamental frequency of the previous frame.

22. The apparatus of claim 21 wherein transcoder is operable to use linear interpolation with resampling to produce a number of predicted magnitudes equal to the number of spectral magnitude parameters for the current frame.

* * * * *